US008141978B2

(12) United States Patent
Miyazawa

(10) Patent No.: US 8,141,978 B2
(45) Date of Patent: Mar. 27, 2012

(54) PRINTER APPARATUS

(75) Inventor: Takashi Miyazawa, Tomi (JP)

(73) Assignee: Mimaki Engineering Co., Ltd., Nagano (JP)

( * ) Notice: Subject to any disclaimer, the term of this patent is extended or adjusted under 35 U.S.C. 154(b) by 0 days.

(21) Appl. No.: 13/033,614

(22) Filed: Feb. 24, 2011

(65) Prior Publication Data

US 2011/0187782 A1 Aug. 4, 2011

Related U.S. Application Data

(63) Continuation of application No. PCT/JP2009/051086, filed on Jan. 23, 2009.

(51) Int. Cl.
*B41J 29/393* (2006.01)
*B41J 25/308* (2006.01)
*B41J 23/00* (2006.01)

(52) U.S. Cl. ..... 347/19; 347/37; 347/8

(58) Field of Classification Search ..... 347/19, 347/16, 37, 8
See application file for complete search history.

(56) References Cited

U.S. PATENT DOCUMENTS

2004/0160502 A1 * 8/2004 Kumamoto et al. ..... 347/19

FOREIGN PATENT DOCUMENTS

| | | |
|---|---|---|
| JP | 2001-328246 | 11/2001 |
| JP | 2006-240026 | 9/2006 |
| JP | 2008-207355 | 9/2008 |

OTHER PUBLICATIONS

International Search Report for International Application No. PCT/JP2009/051086, Feb. 24, 2009.

* cited by examiner

*Primary Examiner* — Julian Huffman
(74) *Attorney, Agent, or Firm* — Ditthavong Mori & Steiner, P.C.

(57) ABSTRACT

A printer apparatus includes a medium supporter to support a printing medium. A carriage holds a printer head provided with a nozzle from which ink is to be ejected onto a printing surface of the printing medium. A carriage moving mechanism moves the carriage along the printing surface of the printing medium supported by the medium supporter. An acceleration detector is configured to detect acceleration of vibration generated in the carriage. A determining device is configured to determine whether a magnitude of the acceleration detected by the acceleration detector exceeds a predetermined threshold value. A controller is configured to control the carriage moving mechanism to restrict relative movement of the carriage when the determining device determines that the magnitude of the acceleration detected by the acceleration detector exceeds the predetermined threshold value.

6 Claims, 9 Drawing Sheets

PRINTER APPARATUS

CROSS-REFERENCE TO RELATED APPLICATIONS

The present application is a continuation application of International Application No. PCT/JP2009/051086, filed Jan. 23, 2009. The contents of this application are incorporated herein by reference in their entirety.

BACKGROUND OF THE INVENTION

1. Field of the Invention

The present invention relates to a printer apparatus.

2. Discussion of the Background

A printer apparatus is an apparatus in which, while a printer head formed with a number of nozzles is relatively moved with respect to a printing medium, ink droplets are ejected from a nozzle of the printer head to a printing medium to draw information such as a character, a figure, a pattern or a photograph on its printing surface. Since the printer apparatus is structured so that ink droplets from the printer head are accurately reached to the printing surface of the printing medium to perform a highly precise drawing, it is important that a space between the under face of the printer head (nozzle opening face) and the printing surface of the printing medium is appropriately adjusted to a predetermined gap. Therefore, the printing surface of the printing medium is normally required to be held by a medium support part so as to be located in a horizontal plane which is parallel to the under face of the printer head. However, when curling is occurred in the printing medium, the printing medium may be largely floated from the medium support part. In this state, when the printer head is moved on the printing medium for performing a predetermined printing, jamming may occur such that the printer head may collide with the floating portion of the printing medium and climb on the printing medium. In addition, when movement of the printer head is continued without recognizing the occurrence of the jamming, the printer head may be damaged due to friction against the printing medium.

As a technique which is capable of coping with this problem, a technique has been disclosed in which a contact type detection mechanism for detecting floating of a printing medium is disposed on both right and left sides in the moving direction of a carriage for scanning the printer head and, when the printing medium is provided with a floating portion exceeding the height of the under face of the printer head, the detection mechanism which is moved to right and left sides together with the carriage contacts with the floating portion to detect occurrence of jamming and stops movement of the carriage for preventing damage of the printer head (see, for example, Japanese Patent Laid-Open No. 2001-328246).

The detection mechanism in the conventional printer apparatus as described above detects occurrence of jamming by means of that a contact piece of the detection mechanism actually contacts with the floating portion of the printing medium. Therefore, when the detecting operation is repeatedly performed, the position of a drive part of the detection mechanism may be displaced by vibration or the contact piece is abraded by friction due to contacting with the printing medium to lower the detection accuracy. As a result, when the printer head and the printing medium are collided with each other, damage of the printer head may be occurred.

SUMMARY OF THE INVENTION

According to one aspect of the present invention, a printer apparatus includes a medium supporter, a carriage, a carriage moving mechanism, an acceleration detector, a determining device, and a controller. The medium supporter supports a printing medium. The carriage holds a printer head provided with a nozzle from which ink is to be ejected onto a printing surface of the printing medium. The carriage moving mechanism moves the carriage along the printing surface of the printing medium supported by the medium supporter. The acceleration detector is configured to detect acceleration of vibration generated in the carriage. The determining device is configured to determine whether a magnitude of the acceleration detected by the acceleration detector exceeds a predetermined threshold value. The controller is configured to control the carriage moving mechanism to restrict relative movement of the carriage when the determining device determines that the magnitude of the acceleration detected by the acceleration detector exceeds the predetermined threshold value.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein:

FIG. 5A is a view showing a speed change of the carriage and FIGS. 5B, 5C, and 5D are views showing changes of output values of an acceleration sensor;

FIG. 6A is a view showing a speed change of the carriage and FIGS. 6B, 6C, and 6D are views showing changes of output values of an acceleration sensor;

FIG. 7A is a view showing a speed change of the carriage and FIGS. 7B, 7C, and 7D are views showing changes of output values of an acceleration sensor;

FIG. 8A is a view showing a speed change of the carriage and FIGS. 8B, 8C, and 8D are views showing changes of output values of an acceleration sensor; FIG. 9A is a view showing a speed change of the carriage and FIGS. 9B, 9C, and 9D are views showing changes of output values of an acceleration sensor.

DESCRIPTION OF THE EMBODIMENTS

Figure 2:
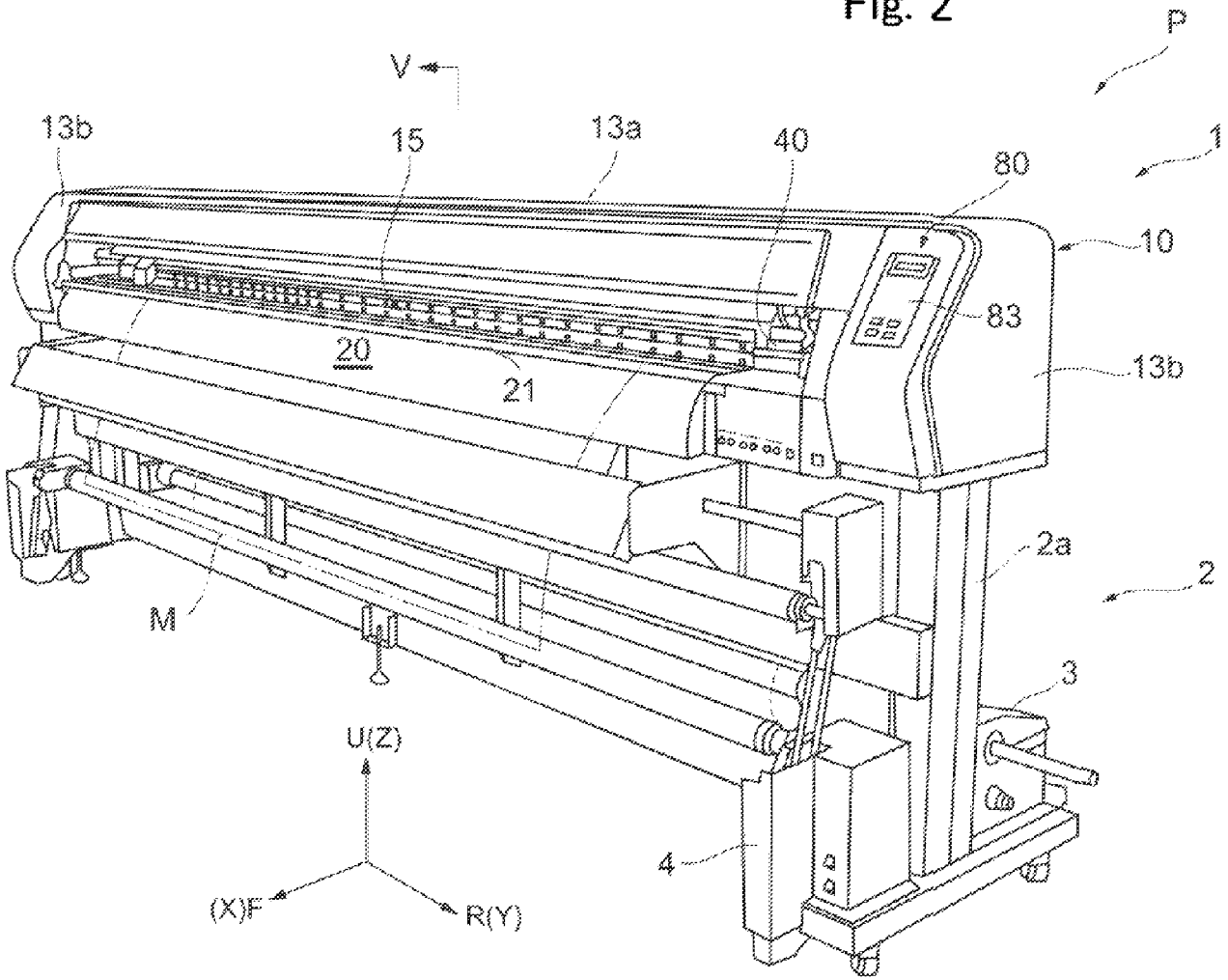
FIG. 2 is a perspective view showing the printer apparatus which is viewed from obliquely front side.
Figure 3:
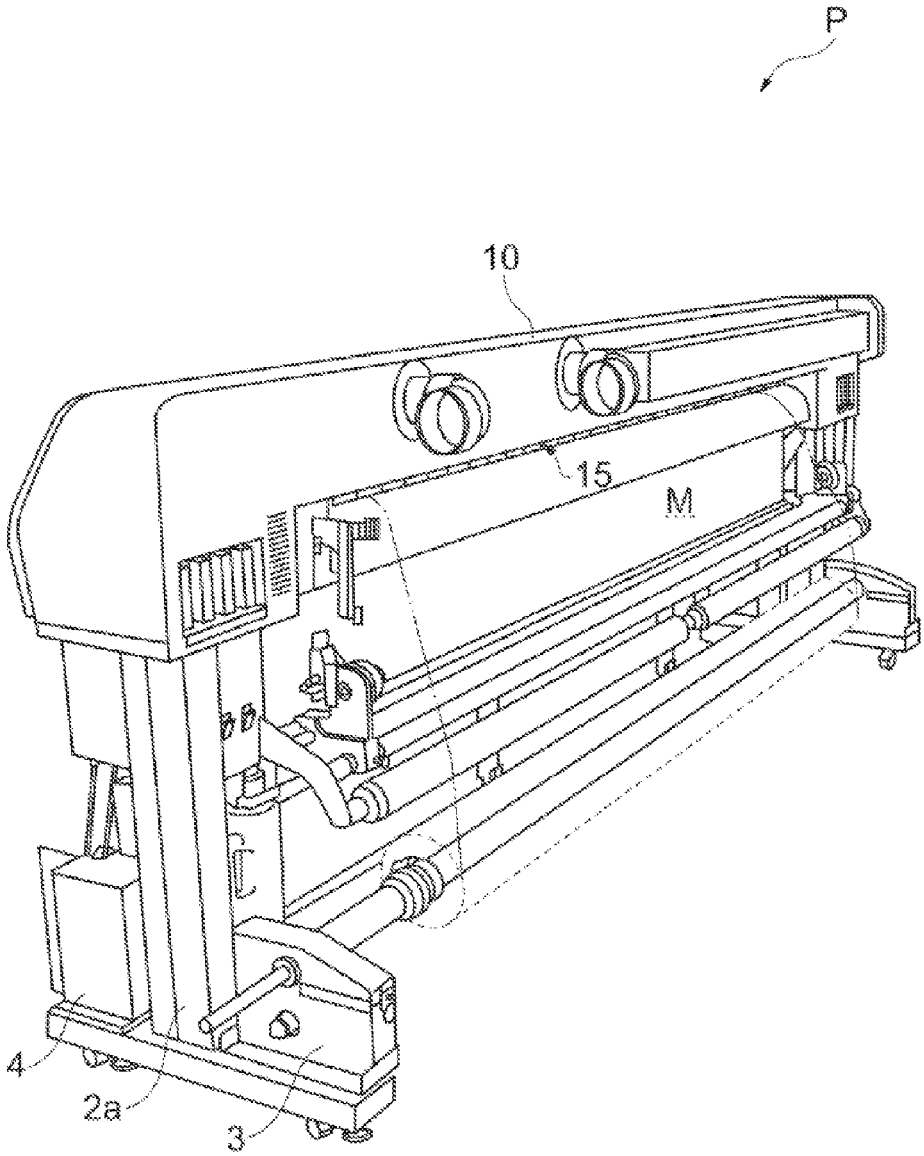
FIG. 3 is a perspective view showing the printer apparatus which is viewed from obliquely rear side.
Figure 4:
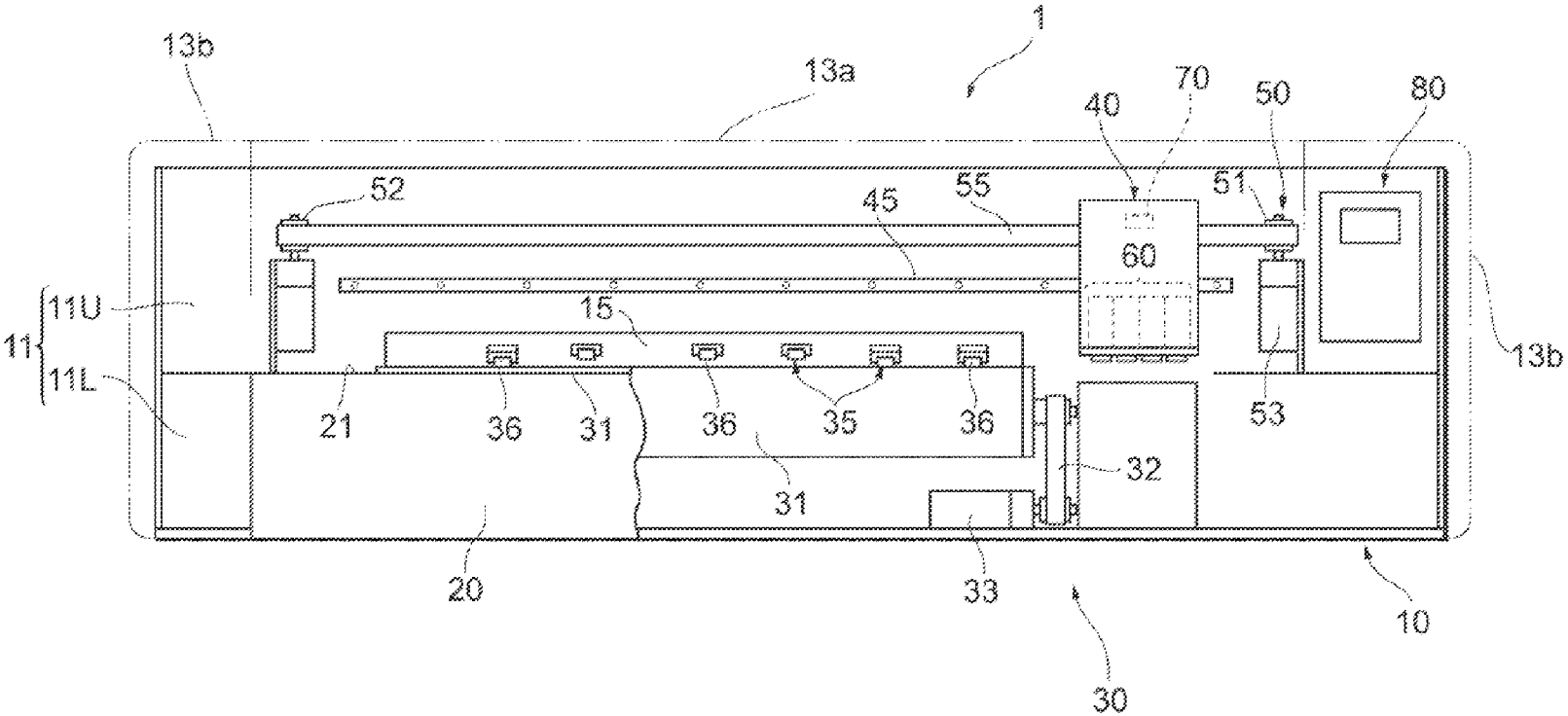
FIG. 4 is a front view showing a structure of a part of an apparatus main body which structures the printer apparatus.

The embodiments of the present invention will be described below with reference to the accompanying drawings, wherein like reference numerals designate corresponding or identical elements throughout the various drawings. As an example of an inkjet printer (hereinafter, referred to as a printer apparatus) in accordance with an embodiment of the present invention, a printer apparatus "P" will be described below which is provided with two axes of "X" and "Y" in which one axis (X-axis) is a printing medium moving direction and the other axis (Y-axis) is a moving direction of a printer head. FIG. 2 is a perspective view showing the printer apparatus "P" which is viewed from obliquely front side and FIG. 3 is a perspective view showing the printer apparatus "P" which is viewed from obliquely rear side. A structure of a part of an apparatus main body 1 which structures the printer apparatus "P" is shown in FIG. 4. First, an entire structure of the printer apparatus "P" will be described below with reference to the drawings. In the following descriptions, directions shown by the arrows "F", "R" and "U" added in FIG. 2 are respectively referred to as the front side, the right side and an upper side, or "X" direction, "Y" direction and "Z" direction.

The printer apparatus "P" is roughly structured of an apparatus main body 1 which is formed in a laterally long and rectangular box-like shape and performs printing work such as characters or figures on a printing surface of a sheet-shaped printing medium "M" such as a vinyl chloride sheet, a tarpaulin or a polyester film referred to as a medium, and a support part 2 which supports the apparatus main body 1 at a height position where working is easily performed. Feeding mechanisms 3 for feeding a printing medium "M" in an unworked state that is wound up in a rolled state to the apparatus main body 1 and winding mechanisms 4 for winding up the printing medium "M" having been printed are provided on front and rear sides of leg parts 2*a* which are disposed on right and left sides and structure the support part 2.

The apparatus main body 1 is mainly structured of a body 10 which is a mounting base for respective mechanisms, a platen 20 which supports a printing medium "M", a medium moving mechanism 30 for moving the printing medium "M" supported by the platen 20 to the front and rear directions, a carriage 40 which is located on an upper side of the platen 20 and supported movably in the right and left directions, a carriage moving mechanism 50 for relatively moving the carriage 40 in the right and left directions with respect to the printing medium "M" that is supported by the platen 20, a plurality of printer heads 60 which is held by the carriage 40 through a predetermined gap with respect to a printing surface of the printing medium "M", and a control unit 80 which controls operations of respective parts of the printer apparatus "P", for example, front and rear movement of the printing medium "M" by the medium moving mechanism 30, right and left movement of the carriage 40 by the carriage moving mechanism 50, and ink ejections from respective nozzles of the printer heads 60.

The body 10 is provided with a main body frame 11 which is comprised of a lower frame 11L on which the platen 20, a feed roller 31 of the medium moving mechanism 30 and the like are mounted, and an upper frame 11U on which roller assemblies 35 of the medium moving mechanism 30 and a support structure for the carriage 40 are mounted. A medium passing part 15 which is formed in a laterally long window shape is formed between the upper frame 11U and the lower frame 11L so that a printing medium "M" is capable of passing through the medium passing part 15 in the front and rear directions. The body 10 is surrounded by a front cover 13*a* which covers a center part of the main body frame 11 and side covers 13*b* which cover the right side and the left side of the main body frame 11 and structured as a whole in a laterally long rectangular box-like shape.

The platen 20 is located at a center part in the right and left direction of the body 10 and is provided on the lower frame 11L so as to extend in the front and rear direction on the lower side of the medium passing part 15. A medium support part 21 whose upper face horizontally supports a printing medium "M" is formed with a drawing region by the printer heads 60 in a band-like shape in the right and left direction. The medium support part 21 is formed with a large number of suction holes having a small diameter which are connected with a decompression chamber (not shown) provided on the lower side. When the decompression chamber is set in a negative pressure state, a printing medium "M" is sucked to and held by the medium support part 21 so that the position of the printing medium "M" is not displaced during working such as printing or cutting. Further, a front end side and a rear end side of the platen 20 are extended to a lower side through a smooth face and a heater for heating the printing medium "M" and drying inks just after having been printed is provided in a paper delivery region on the front side.

The medium moving mechanism 30 is mainly structured of a feed roller 31 in a cylindrical shape which is turnably provided on a turning shaft extending in the right and left direction and disposed so that an upper peripheral face of the feed roller 31 is exposed to the medium support part 21 of the platen 20, a servomotor 33 for rotationally driving the feed roller 31, a timing belt 32 which is stretched between a driven pulley coupled to a shaft end of the feed roller 31 and a drive pulley coupled to a shaft end of the servomotor 33, and a plurality of roller assemblies 35 which are respectively provided with a pinch roller 36 turnable in the front and rear directions and disposed with a predetermined interval in the right and left direction on an upper side of the feed roller 31.

The roller assembly 35 is structured so as to be capable of setting at a clamp position where the pinch roller 36 is elastically engaged with the feed roller 31 and at an unclamp position where the pinch roller 36 is separated from the feed roller 31 to the upper side. When the roller assemblies 35 are set at the clamp position and the servomotor 33 is rotationally driven in a state that a printing medium "M" is sandwiched between the pinch rollers 36 and the feed roller 31 disposed on the upper and lower sides, the printing medium "M" is carried in the front and rear direction by a feeding amount corresponding to a rotation angle of the feed roller 31, in other words, by a feed amount corresponding to a drive control value outputted from a control unit 80 to the servomotor 33. In FIG. 4, the roller assemblies 35 are shown both in the state at the clamp position and the state at the unclamp position.

The upper frame 11U located on the upper side of the medium passing part 15 is attached with a guide rail 45 which is extended in the right and left direction in parallel to the feed roller 31 and the carriage 40 holding a plurality of the printer heads 60 is supported by the guide rail 45 so as to be movable in the right and left direction. The guide rail 45 is a support rail with a linear motion bearing which is referred to as a linear-motion guide or a linear guide. The carriage 40 is fixed to a slide block (also referred to as a ball housing or the like) which is fitted to and supported by the guide rail 45 and, in this manner, the carriage 40 is supported on the upper side of the platen 20 so as to be slidable in the right and left directions and moved in the right and left directions by the carriage moving mechanism 50 as described below.

The carriage moving mechanism 50 is structured of a drive pulley 51 and a driven pulley 52 which are respectively provided in the vicinities of the right and left side ends of the guide rail 45, a servomotor 53 for rotationally driving the drive pulley 51, an endless belt type timing belt 55 which is stretched over the drive pulley 51 and the driven pulley 52, and the like. The carriage 40 is connected and fixed to the timing belt 55. Rotation of the servomotor 53 is controlled by the control unit 80 and the carriage 40 is moved in the right and left directions by feeding amounts corresponding to drive control values outputted from the control unit 80 to the servomotor 53.

The printer heads 60 are provided on an under face of the carriage 40 so as to be separated from a printing medium "M", which is horizontally supported on the medium support part 21 of the platen 20, through a predetermined gap. Various types of structures may be adapted as an arrangement structure of the printer heads 60 and thus an appropriate structure may be utilized. In this embodiment, as one example, a large number of nozzles from which minute ink droplets are ejected are linearly arranged to form two nozzle rows in the front and rear direction in a juxtaposed parallel manner and four printer heads 60 having the two nozzle rows are arranged in the right and left direction so that totaled 8 (eight) nozzle rows are disposed.

Figure 1:
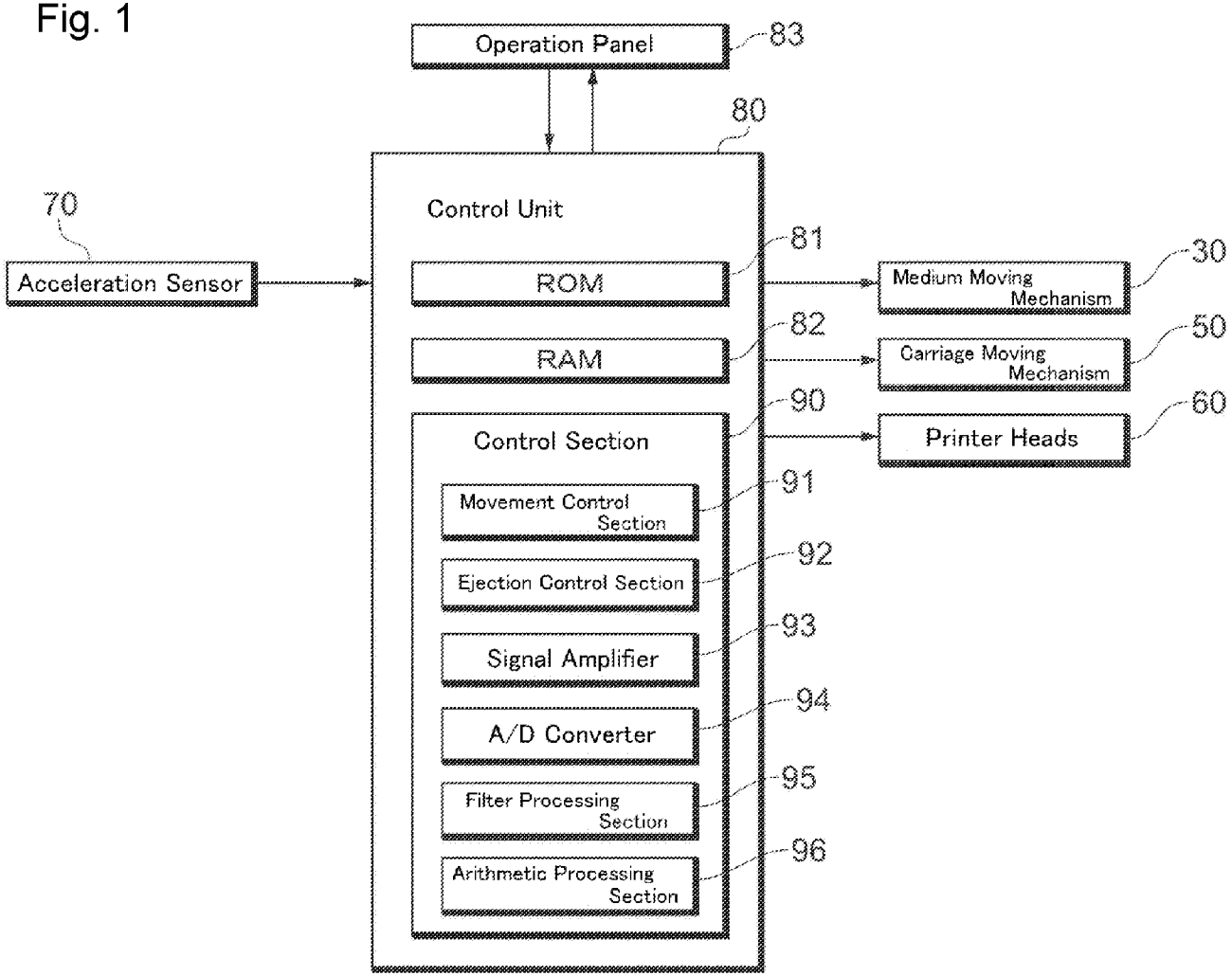
FIG. 1 is a schematic block diagram showing a printer apparatus according to an embodiment of the present invention.

A schematic block diagram of the printer apparatus "P" is shown in FIG. 1. The control unit 80 is provided with a ROM 81 into which control programs for controlling operations of respective parts of the printer apparatus "P" are written, a RAM 82 which temporarily stores printing programs and the like for drawing on a printing medium "M", a control section 90 which executes arithmetic processing on the basis of the printing program read from the RAM 82, operation signals inputted from an operation panel 83 and the like and controls operations of the respective parts according to a control program, a display panel which displays an operating condition and the like of the printer apparatus "P", the operation panel 83 which is provided with various operation switches, and the like. The control unit 80 controls front and rear movement of a printing medium "M" by the medium moving mechanism 30, right and left movement of the carriage 40 by the carriage moving mechanism 50, ink ejections from the respective nozzles of the printer heads 60 and the like.

Specifically, the control unit 80 feeds a printing medium "M" to a predetermined reference position by the medium moving mechanism 30 and sucks and holds on the medium support part 21 of the platen 20. While moving the carriage 40 by the carriage moving mechanism 50 in the right and left directions, the control unit 80 makes ink droplets having color and size on the basis of a working program eject from the respective nozzles of the four printer heads 60 to positions in the right and left direction on the basis of a printing program to form an ink ejection region in a laterally long strip shape. This operation is combined and alternately performed with front and rear movement of the printing medium "M" by the medium moving mechanism 30 to create predetermined information such as characters, figures and images on the basis of the printing program on a printing surface of the printing medium "M".

In the printer apparatus "P" which is structured as described above, while the carriage 40 is moved in the right and left directions (one way or reciprocatedly) in a state that under faces of the printer heads 60 and the printing surface of the printing medium "M" are separated from each other through a predetermined gap, ink droplets are ejected to the printing surface of the printing medium "M" from the respective nozzles of the printer heads 60.

However, when printing is to be performed by using the printer apparatus "P", due to various malfunctions such as effect of curling of a printing medium "M", a feeding failure of a printing medium "M" by the medium moving mechanism 30 or a sucking failure of a printing medium "M" by the platen 20, a part of the printing medium "M" which is an object to be printed may be in a floating state from the medium support part 21 of the platen 20, in other words, a part of the printing surface (floating portion) of the printing medium "M" may be located at a height higher than the under faces of the printer heads 60. As a result, with a right and left movement of the carriage 40, so-called medium jamming may occur in which the printer heads 60 have climbed on the floating portion (protruded portion) of the printing medium "M". After the printer heads 60 have climbed on the printing medium "M" as described above, when the right and left movement of the carriage 40 is continued in the state that the printer heads 60 and the printing medium "M" have been contacted with each other, the printer heads 60 may be damaged by friction against the printing medium "M".

In order to prevent the problem, the printer apparatus "P" in this embodiment is provided with a medium jamming detection function which quickly detects contact of the carriage 40 with a printing medium "M" to interrupt (stop) the printing operation in the printer apparatus "P" and the control unit 80 controls operations of the respective parts.

A control structure for realizing the medium jamming detection function is, as shown in FIG. 1, roughly structured of an acceleration sensor 70 for detecting acceleration acted on the carriage 40, a control section 90 of the control unit 80, and the medium moving mechanism 30, the carriage moving mechanism 50 and the printer heads 60 which perform predetermined operations on the basis of command signals outputted from the control section 90.

The acceleration sensor 70 is mounted on a printed circuit board not shown within the carriage 40 (see FIG. 4) and detects a vibration acted on the carriage 40 as a change of the acceleration. The acceleration sensor 70 is structured of a three-axes acceleration sensor which is capable of detecting accelerations of three directional vibration components acted on the carriage 40 with a single sensor. The three-axes acceleration sensor is disposed so that three detectable directions are coincided with the right and left direction in which the carriage 40 is moved reciprocatedly ("Y" direction), the front and rear direction which is a feed direction of a printing medium "M" ("X" direction), and the upper and lower direction which is a height direction of the printer heads 60 ("Z" direction).

At the time of printing operation in the printer apparatus "P", the acceleration sensor 70 is moved together with the carriage 40 in the right and left direction by the carriage moving mechanism 50 in the state that the acceleration sensor 70 is fixed within the carriage 40. Therefore, the acceleration sensor 70 detects a change of acceleration in the right and left direction ("Y" direction) which is acted on the carriage 40 with change of the moving speed (acceleration and deceleration) due to a scanning movement of the carriage 40. Similarly, during the scanning movement of the carriage 40, the acceleration sensor 70 detects a vibration generated in the carriage 40 as a change of acceleration in a case that, for example, the printer head 60 has contacted with a floating portion (protruded portion) of a printing medium "M". The acceleration sensor 70 detects acceleration acted on the carriage 40 for each component of the X-axis direction, the Y-axis direction and the Z-axis direction with a constant minute time interval and analog voltage signals having been detected which are proportional to a magnitude of the acceleration are successively outputted to the control section 90 of the control unit 80.

The control section 90 of the control unit 80 is provided with a movement control section 91 which controls drive of the medium moving mechanism 30, the carriage moving mechanism 50 and the like, an ejection control section 92 which controls ejection of ink droplets from the printer heads 60, a signal amplifier 93, A/D converter (analog/digital conversion section) 94, a filter processing section 95 and an arithmetic processing section 96.

The analog voltage signal which is outputted from the acceleration sensor 70 is amplified by the signal amplifier 93 of the control unit 80 and then converted to a digital signal (digital value) by the A/D converter 94 to be inputted to the filter processing part 95.

Figure 5A:
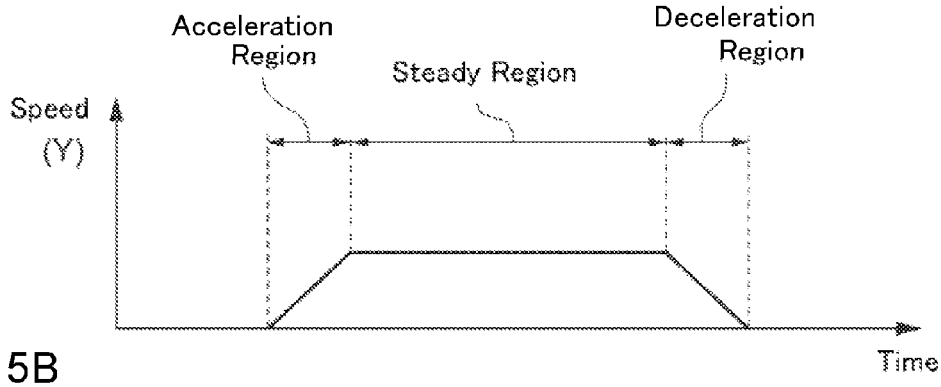
FIGS. 5A, 5B, 5C, and 5D are explanatory views showing characteristics of speed and accelerations at the time of a normal scanning movement of a carriage.
Figure 5B:
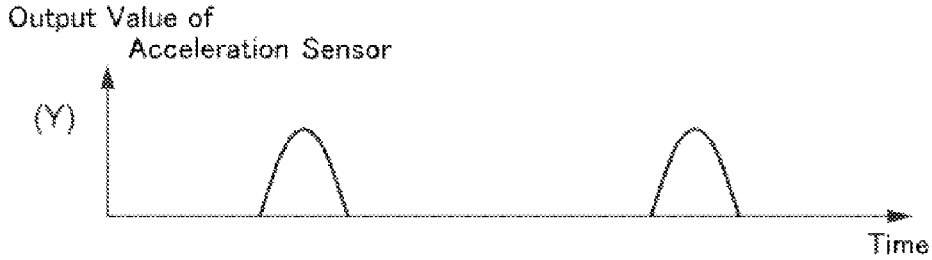
Figure 5C:
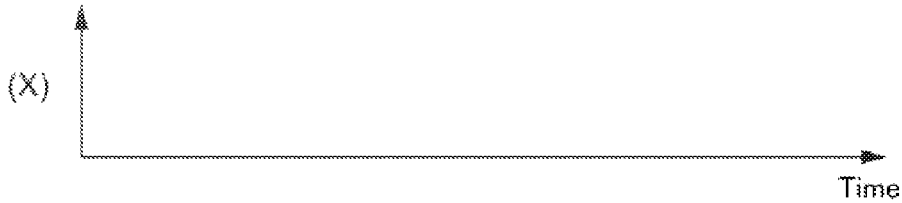
Figure 5D:
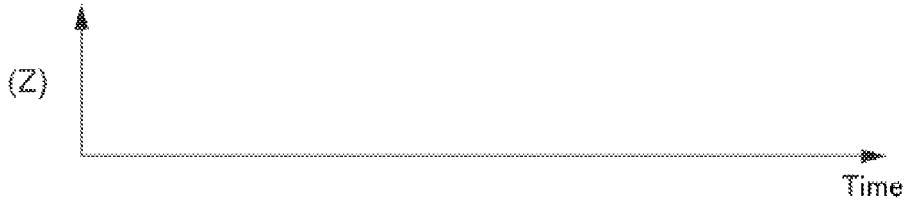
Figure 6A:
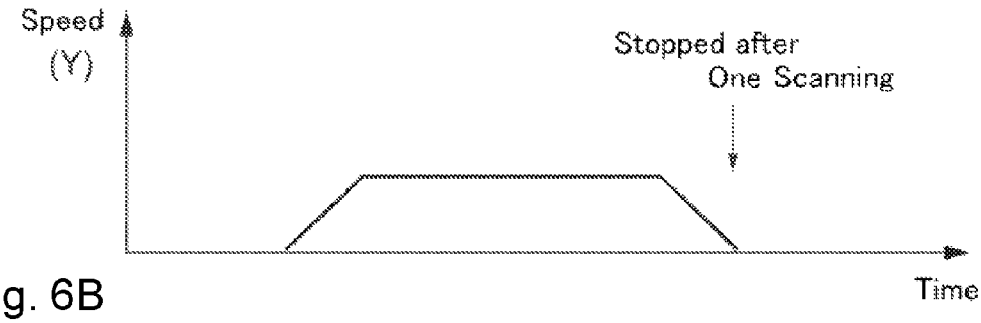
FIGS. 6A, 6B, 6C, and 6D are explanatory views showing characteristics of speed and accelerations when a carriage has been stopped after one scanning operation due to occurrence of a minor medium contact.
Figure 6B:
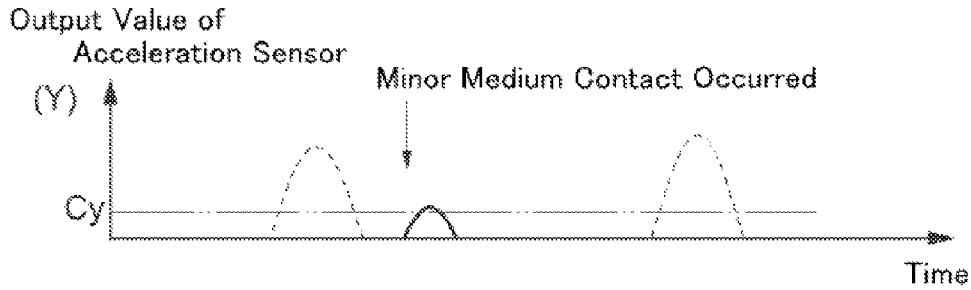
Figure 6C:
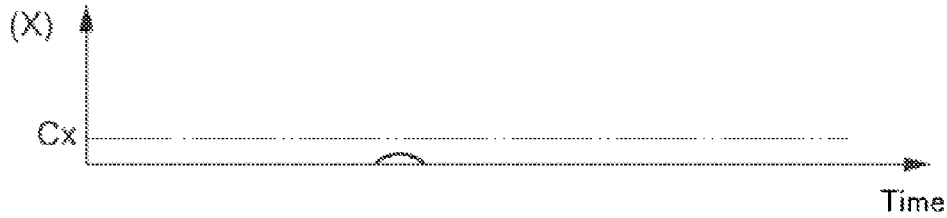
Figure 6D:
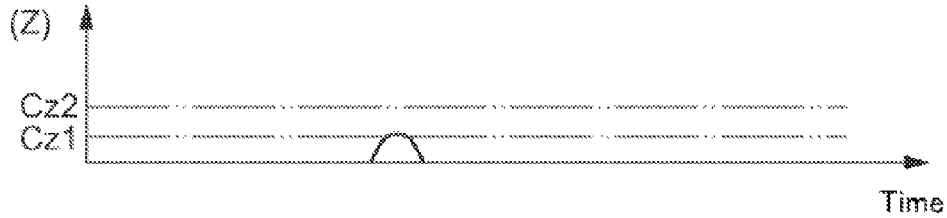
Figure 7A:
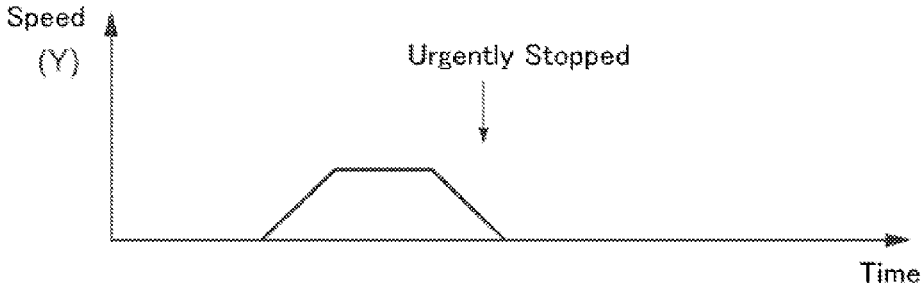
FIGS. 7A, 7B, 7C, and 7D are explanatory views showing characteristics of speed and accelerations when a carriage is urgently stopped due to occurrence of a minor medium contact.
Figure 7B:
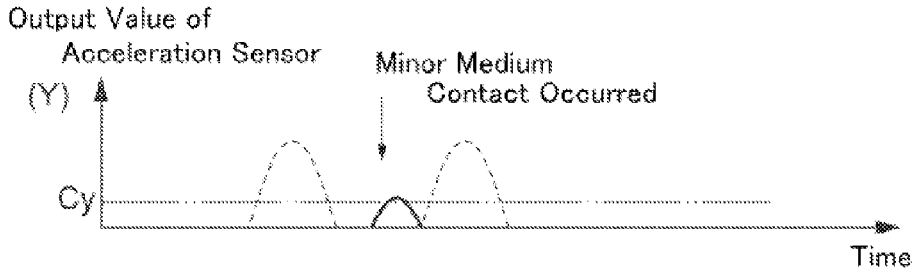
Figure 7C:
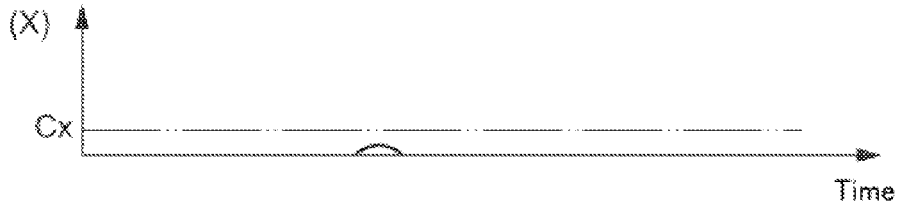
Figure 7D:
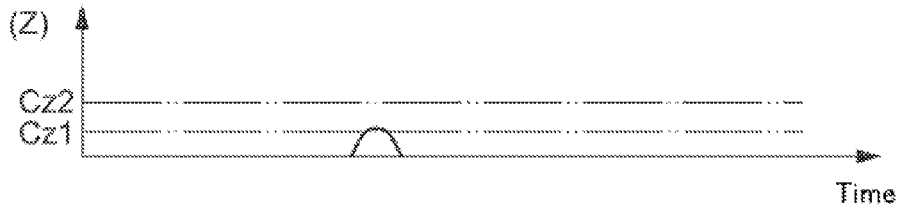
Figure 8A:
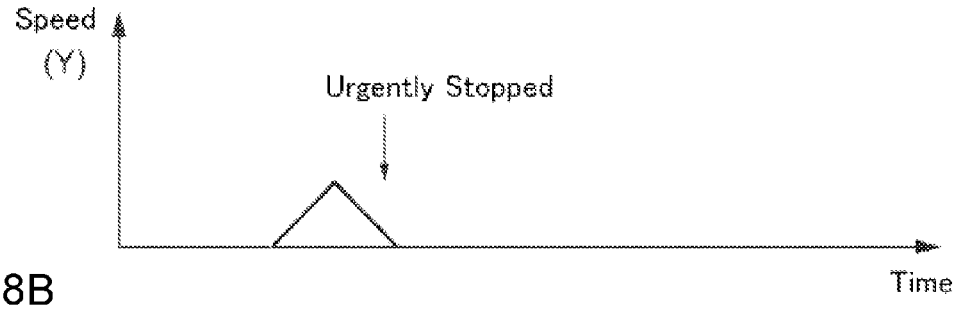
FIGS. 8A, 8B, 8C, and 8D are explanatory views showing characteristics of speed and accelerations of a carriage when medium jamming has occurred.
Figure 8B:
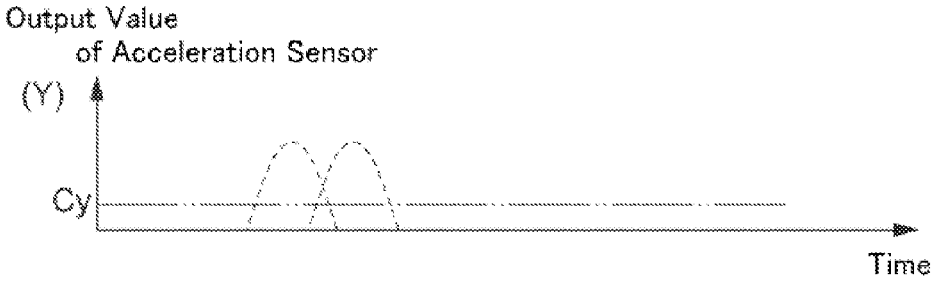
Figure 8C:
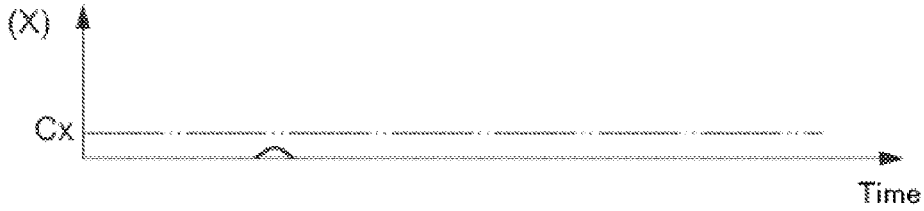
Figure 8D:
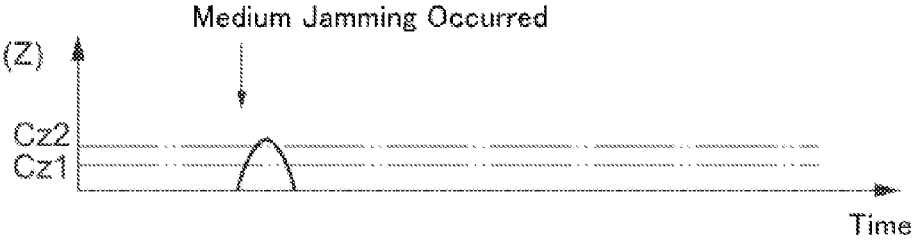
Figure 9A:
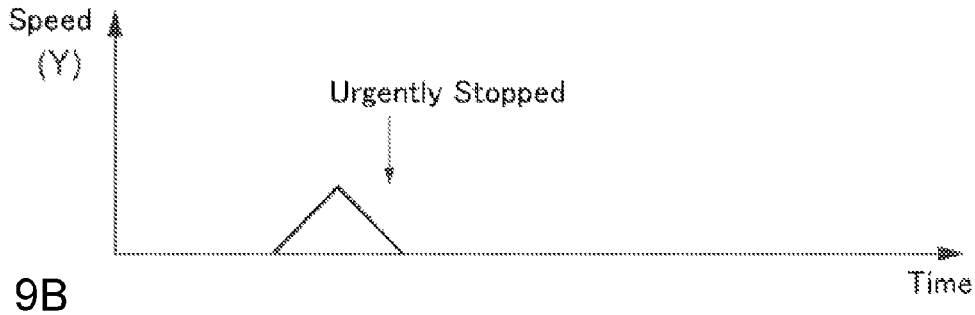
FIGS. 9A, 9B, 9C, and 9D are explanatory views showing characteristics of speed and accelerations of a carriage when abnormality has occurred in a drive system of the carriage.
Figure 9B:
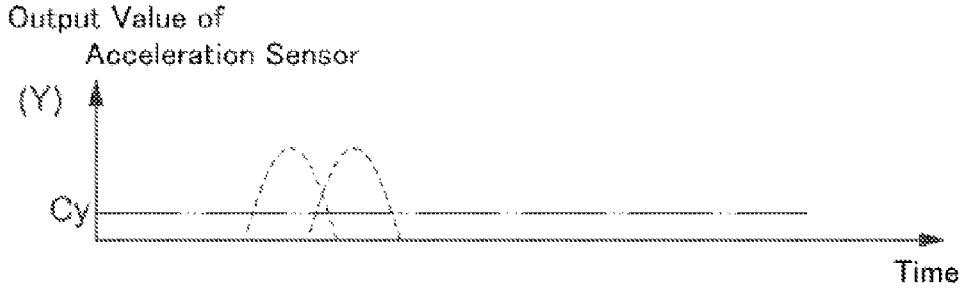
Figure 9C:
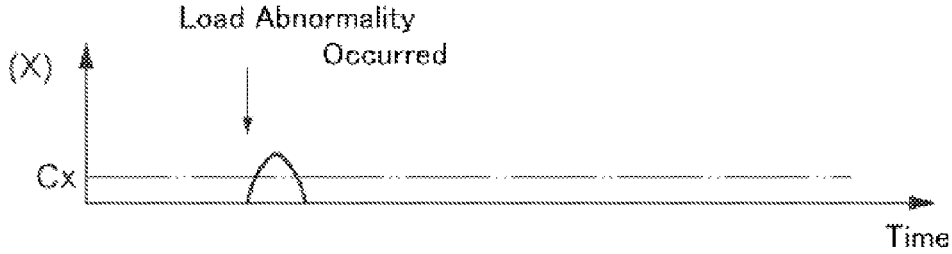
Figure 9D:
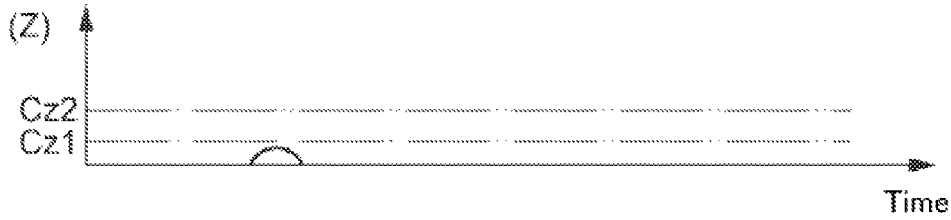

In this embodiment, FIG. 5A shows a speed change in the "Y" direction of the carriage 40 in a scanning movement of the carriage 40 (one way scanning region). FIGS. 5B, 5C and 5D show changes of the acceleration sensor output values (digital converted value) of the "X" direction, the "Y" direction, and the "Z" direction which are detected by the acceleration sensor 70. A scanning region of the carriage 40 is, as shown in FIG. 5A, divided into three regions of an acceleration region, a steady region and a deceleration region. The acceleration region is a region from the time when movement (acceleration) of the carriage 40 is started in the right and left direction ("Y" direction) until the time when the movement of the carriage 40 has reached to a predetermined moving speed for performing printing operation by the printer heads 60. The steady region is a region where acceleration of the carriage 40 has finished and, while the carriage 40 is moved with a predetermined moving speed (constant speed), information corresponding to the printing program is drawn on a printing medium "M" by the printer heads 60. When the carriage 40 is moved at a constant speed as described above, a flight trajectory of an ink droplet which is ejected from each of the nozzles of the printer heads 60 to the printing medium "M" is stabilized and the ink droplet can be accurately reached to a desired position on the printing surface. The deceleration region is a region from the time when drawing by the printer heads 60 has finished and the carriage 40 is decelerated from the predetermined moving speed until the carriage 40 has stopped. The inclination of the graph in FIG. 5A means acceleration in the "Y" direction of the carriage 40. The acceleration sensor 70 detects the acceleration and the detection signal is processed by the signal amplifier 93 and the A/D converter 94 of the control unit 80 and, as a result, waveforms of acceleration sensor output values shown in FIGS. 5B through 5D are obtained.

The filter processing section 95 is provided with a function as a digital filter. The filter processing section 95 performs filter processing in which, in the acceleration signal from the A/D converter 94 (digital signal), the weight of the detection signal in the "Y" direction (scanning direction of the carriage 40) in the acceleration region and the deceleration region during the printing operation of the carriage 40 is lowered or ignored and only acceleration signal component of a vibration caused by an effect other than a normal printing operation is extracted. In other words, the information of acceleration shown in FIG. 5B (acceleration sensor output value) acted on the carriage 40 at the time of a normal printing operation is eliminated (or detection value is lowered) by the filter processing section 95.

The arithmetic processing section 96 compares the acceleration sensor output values in the three directions of "X", "Y" and "Z" of the carriage 40 outputted with a minute time interval from the filter processing section 95 with predetermined threshold values set for each of the directions and, when the acceleration sensor output value exceeds the predetermined threshold value, the arithmetic processing section 96 judges that the printer heads 60 have contacted with a floating part (protruded part) of a printing medium "M" with movement in the right and left direction of the carriage 40. As a result, the arithmetic processing section 96 outputs restriction signals to the movement control section 91 and the ejection control section 92 so that movement of the carriage 40 by the carriage moving mechanism 50, feeding of the printing medium "M" by the medium moving mechanism 30, and ejection of ink droplets from the printer heads 60 are controlled to be forcibly stopped.

The predetermined threshold value which is an object to be compared with an acceleration sensor output value in the arithmetic processing section 96 is previously set for each direction of "X", "Y" and "Z" in the arithmetic processing section 96. As an example of the predetermined threshold value, a threshold value "Cx" for an acceleration sensor output value in the "X" direction, a threshold value "Cy" for an acceleration sensor output value in the "Y" direction, and threshold values "Cz1" and "Cz2" for the acceleration sensor output value in the "Z" direction are set respectively. Since the threshold values "Cx", "Cy", "Cz1" and "Cz2" are set as described above, even when a weak mechanical vibration acted on the carriage 40 is detected as accelerations of the respective directions of "X", "Y" and "Z" at the time of a printing operation of the printer apparatus "P", the output values do not exceed the threshold values and the weak mechanical vibration is ignored.

Next, three examples where the printer heads 60 are contacted with a floating part (protruded part) of a printing medium "M" during scanning movement of the carriage 40 will be described below with reference to FIGS. 6A through 9D. FIGS. 6A through 6D and FIGS. 7A through 7D show cases when a minor medium contact is detected, FIGS. 8A through 8D show a case that occurrence of medium jamming such that the printer heads 60 have climbed on a printing medium "M" is detected, and FIGS. 9A through 9D show a case that occurrence of medium jamming such that a mechanical trouble may occur in the drive system for the carriage 40 is detected. The A through D in the respective drawings show the speed change in the "Y" direction of the carriage 40, and changes of acceleration sensor output values in three directions of "X", "Y" and "Z" which are obtained corresponding to the speed change of the carriage 40.

In a case that a minor medium contact has occurred such that the printer head 60 is contacted with a floating portion (protruded portion) of a printing medium "M" during scanning movement of the carriage 40, reactions in the "Y" direction and the "Z" direction among accelerations of respective vibration components in the "X", "Y" and "Z" directions acted on the carriage 40 are largely detected as shown in FIGS. 6A through 6D and FIGS. 7A through 7D. This is because that, when the carriage 40 has contacted with the medium, the floating portion (protruded portion) of the printing medium "M" applies large resistance forces to the carriage 40 in the "Y" direction and the "Z" direction. Therefore, when an acceleration sensor output value in the "Y" direction exceeding the appropriately adjusted threshold value "Cy" or an acceleration sensor output value in the "Z" direction exceeding the threshold value "Cz1" is inputted into the arithmetic processing section 96, the arithmetic processing section 96 detects occurrence of a minor medium contact. In this case, the arithmetic processing section 96 outputs restriction signals to the movement control section 91 and the ejection control section 92 and controls so that the printing operation of the printer apparatus "P" is stopped. However, in a case of the minor medium contact, requirement of urgent stopping is relatively low and thus, in this embodiment, the stopping method may be selected by a user setting which is inputted through the operation panel 83. In other words, in this case, two methods may be selected, one of which is that, after the carriage 40 has been moved by only one scanning (one way), the carriage 40 is stopped and set in an operation waiting state (see FIGS. 6A through 6D) and, the other of which is that the carriage 40 is urgently stopped at the time when a medium contact is detected (see FIGS. 7A through 7D).

In this embodiment, when the carriage 40 is contacted with a printing medium "M" during acceleration or deceleration, accelerations in the "Y" direction and the "Z" direction may be mainly detected. However, in this case, the acceleration sensor output value in the "Y" direction is overlapped with the acceleration sensor output value caused by acceleration or deceleration of the carriage 40 and the values are ignored (or detection values are lowered) by the digital filter processing through the filter processing section 95 and thus an appropriate judgment cannot be executed. Therefore, in this case, a minor medium contact is detected on the basis of that the acceleration sensor output value in the "Z" direction exceeds the threshold value "Cz1" and the printing operation of the printer apparatus "P" is stopped.

Next, during a scanning movement of the carriage 40, in a case that the printer head 60 has climbed on a floating portion (protruded portion) of a printing medium "M" to occur medium jamming in such a manner that the printing medium "M" is overlapped with each other, a reaction in the "Z" direction is mainly detected largely among accelerations of the respective vibration components of "X", "Y" and "Z" direction acted on the carriage 40 as shown in FIGS. 8A through 8D. This is because that, when the printer head 60 have climbed on the printing medium "M", the overlapping portion of the printing medium "M" applies a large resistance force in the "Z" direction to the under face of the printer head 60. Therefore, when an acceleration sensor output value in the "Z" direction which exceeds the appropriately adjusted threshold values "Cz1" and "Cz2" is inputted into the arithmetic processing section 96, the arithmetic processing section 96 detects occurrence of medium jamming that the printer head 60 has climbed on the printing medium "M". In this case, when movement of the carriage 40 is continued, the printer head 60 may be damaged largely by friction against the printing medium "M". Therefore, when occurrence of the medium jamming is detected, the arithmetic processing section 96 outputs restriction signals to the movement control section 91 and the ejection control section 92 and controls so that the printing operation of the printer apparatus "P" is urgently stopped. In this embodiment, after the printer apparatus "P" has been urgently stopped, the outputs of the restriction signals from the arithmetic processing section 96 are stopped and, under a condition that the trouble (medium jamming) is eliminated, the printing operation of the printer apparatus "P" may be performed again.

Next, in a case that the carriage moving mechanism 50 for moving the carriage 40 for scanning is subjected to a load, which exceeds an endurable strength of its drive system, by a collide with the printing medium "M" through occurrence of medium jamming, a reaction in the "X" direction is mainly detected largely among accelerations of the respective vibration components of "X", "Y" and "Z" direction acting on the carriage 40 as shown in FIG. 9A through 9D. In this case, even when the printer head 60 has climbed on a printing medium "M", urgent stopping normally prevents a serious trouble from occurring in the drive system. On the other hand, a load which may cause a trouble to occur in the drive system due to an unexpected situation is applied to the carriage 40, acceleration in the "X" direction acted on the carriage 40 becomes extremely larger than the normal level. Therefore, when an acceleration sensor output value in the "X" direction exceeding the appropriately adjusted threshold value "Cx" is inputted into the arithmetic processing section 96, the arithmetic processing section 96 detects abnormality of the drive system for the carriage 40 caused by medium jamming. When the arithmetic processing section 96 detects abnormality as described above, the arithmetic processing section 96 judges that a trouble which is difficult to restore is occurred in the apparatus, and outputs restriction signals to the movement control part 91 and the ejection control section 92 and controls so that the printing operation of the printer apparatus "P" is urgently stopped.

The arithmetic processing section 96 of the control unit 80 executes control of restricting the printing operation of the printer apparatus "P" through the movement control part 91 and the ejection control section 92 as described above and outputs a detection signal of occurrence of abnormality to the operation panel 83 to display a message corresponding to the detected content on the operation panel 83. For example, when acceleration sensor output values exceed the threshold values "Cy" and "Cz1" as shown in FIGS. 6A through 6D and FIGS. 7A through 7D, the operation panel 83 is displayed with contents of a message (cause of abnormality and restoring method) such as "warning: medium contact occurred: confirmation is required". As shown in FIGS. 8A through 8D, when an acceleration sensor output value exceeds the threshold value "Cz2", the operation panel 83 is displayed with contents of a message such as "error medium jamming occurred: elimination of medium jamming is required" and, when an acceleration sensor output value exceeds the threshold value "Cx" as shown in FIGS. 9A through 9D, contents of a message such as "error: abnormal load is applied: service call is required" are displayed on the operation panel 83.

The entire structure of the printer apparatus "P" has been described above and next, an operation of the printer apparatus "P" when the medium jamming detection function is executed will be described below.

A printing medium "M" which is an object to be printed is mounted in the printer apparatus "P" so as to be carried from the rear side to the front side on the platen 20. The printing medium "M" is carried on the platen 20 to the front side by turning the feed roller 31 in a state that the printing medium "M" is sandwiched between the rollers 36 and 31 disposed on the upper and lower sides. In this case, while the carriage 40 is reciprocatedly moved by the carriage moving mechanism 50 along the guide rail 45 in the right and left direction, ink droplets are ejected from nozzle openings of the under faces of the respective printer heads 60 to the printing medium "M" placed on the platen 20 to stick the ink droplets on the printing medium "M" with a desired pattern. Then, operations are repeatedly performed in which, after the printing medium "M" has carried to the front side by a predetermined pitch, while the carriage 40 is moved reciprocatedly in the right and left direction again, the ink droplets are ejected from the nozzle openings of the printer heads 60.

At the time of printing operation in the printer apparatus "P", accelerations acted on the carriage 40 are detected by the acceleration sensor 70 mounted on the carriage 40 with a minute time interval and information of detected acceleration (acceleration sensor output values) is compared with the predetermined threshold values in the arithmetic processing section 96 of the control unit 80 and occurrence of medium jamming is monitored. In this embodiment, an output signal of acceleration detected by the acceleration sensor 70 in a normal operation of the carriage 40 is amplified and digitally processed and then, weighting is lowered or ignored in the filter processing section 95 of the control unit 80. Therefore, the output signal is excluded from an object to be judged in the arithmetic processing section 96 whether medium jamming is occurred or not (judged that abnormality does not occur in the printer apparatus "P") and the printing operation of the printer apparatus "P" is continued.

On the other hand, change of acceleration of the carriage 40 is detected by the acceleration sensor 70 during a scanning movement of the carriage 40 and, when judged by the arithmetic processing section 96 that acceleration sensor output values (of respective vibration components of "X", "Y" and "Z" directions) extracted in the filter processing section 95 exceed the predetermined threshold values, occurrence of medium jamming is foreseen and thus the restriction signals are outputted to the movement control section 91 and the ejection control section 92. As a result, movement of the carriage 40 by the carriage moving mechanism 50, feeding of the printing medium "M" by the medium moving mechanism 30, and ejection of ink droplets from the printer heads 60 are controlled so as to be forcibly stopped and contents of abnormality corresponding to the threshold values "Cx", "Cy", "Cz1" and "Cz2" which are exceeded by the acceleration sensor output values are displayed on the operation panel 83 to notify the content to an operator.

For example, in accelerations of the respective vibration components of "X", "Y" and "Z" directions acted on the carriage 40, when an acceleration sensor output value in the "Y" direction exceeds the threshold value "Cy", (or when an acceleration sensor output value in the "Z" direction exceeds the threshold value "Cz1"), the arithmetic processing section 96 judges that a minor medium contact has occurred and the printing operation of the printer apparatus "P" is stopped by a stopping method corresponding to a user setting through the operation panel 83 (the carriage 40 is moved by one scanning and then stopped, or urgently stopped when detected). Further, a message of "warning: medium contact occurred: confirmation is required" is displayed on the operation panel 83. Therefore, an operator checks conditions of the printer heads 60, the carriage 40, the printing medium "M" and the like and, when a problem is not found, the printing is restarted through a predetermined operation procedure. In a case that the carriage 40 has been urgently stopped on the basis of a user setting, in order to prevent a printing quality from lowering in the portion at the stopped position, it is preferable that the printing is restarted from the beginning again after the printing medium "M" is exchanged for a new one.

Further, in the accelerations of the respective vibration components of "X", "Y" and "Z" directions acted on the carriage 40, when the acceleration sensor output value in the "Z" direction exceeds the threshold value "Cz2", the arithmetic processing section 96 judges that medium jamming such that the printer heads 60 have climbed on a printing medium "M" has occurred and the printing operation of the printer apparatus "P" is immediately and urgently stopped. Further, a message of "error: medium jamming occurred: elimination of medium jamming is required" is displayed on the operation panel 83. Therefore, after urgently stopped, an operator eliminates the trouble (medium jamming) and then the printing may be restarted from the beginning again after the printing medium "M" is exchanged for a new one.

Further, in the accelerations of the respective vibration components of "X", "Y" and "Z" directions acted on the carriage 40, when the acceleration sensor output value in the "X" direction exceeds the threshold value "Cx", the arithmetic processing section 96 judges that abnormality of load has occurred in the drive system of the carriage 40 due to a medium jamming and the printing operation of the printer apparatus "P" is immediately and urgently stopped. Further, a message of "error: abnormal load is applied: service call is required" is displayed on the operation panel 83. Therefore, an operator is notified of that a trouble whose recovery is difficult has occurred and thus an appropriate measure for restoring the printer apparatus "P" from the mechanical trouble can be performed.

According to the printer apparatus "P" which is structured as described above, when an acceleration sensor output value detected by the acceleration sensor 70 exceeds a predetermined threshold value, occurrence of medium jamming is immediately foreseen or detected and thus the printing operation of the printer apparatus "P" is stopped. Therefore, it is prevented that the scanning movement of the carriage 40 is continued under a condition that the printer head 60 has contacted with the printing medium "M" to cause the printer head 60 to be damaged.

Further, the threshold values are individually set for respective directions with respect to accelerations of respective vibration components of "X", "Y" and "Z" directions and, when an acceleration sensor output value of the vibration component exceeding the threshold value is outputted, it is judged that abnormality corresponding to the direction of the acceleration has occurred and thus a restriction control corresponding to the content of the abnormality is performed on the printing operation of the printer apparatus "P" and the content of the abnormality and a method of restoration are notified to an operator rapidly. Therefore, an operator is capable of definitely recognizing the cause of abnormality in the scanning movement of the carriage 40 and thus an appropriate measure for restoring the printer apparatus "P" can be performed.

In addition, in the accelerations acted on the carriage 40 which are detected by the acceleration sensor 70 with a minute time interval, the acceleration at the time of normal operation of the carriage 40 (at the time of acceleration and deceleration) and an acceleration of vibration acted on the carriage 40 due to an external force such as medium jamming are distinguished from each other accurately by the filter processing section 95. Therefore, occurrence of abnormality such as medium jamming is detected further surely because a peculiar acceleration except the acceleration and deceleration of the carriage 40 among accelerations acted on the carriage 40 is detected.

In the embodiment described above, the acceleration sensor 70 for detecting acceleration acted on the carriage 40 is a three-axes acceleration sensor which is capable of detecting accelerations of three directions of "X", "Y" and "Z" with a single sensor and mounted on a circuit board (not shown) within the carriage 40. However, for example, three (one axis) acceleration sensors which are capable of detecting only acceleration in one direction may be used and mounted on the carriage 40 so that respective detections are coincided with respective directions of "X", "Y" and "Z". In this case, in order to detect occurrence of medium jamming with a high degree of accuracy, it is preferable that the acceleration sensors are mounted on a lower part of the carriage 40 which is located at a position in the vicinity of a printing medium "M" (for example, on a face where the printer heads 60 are mounted).

In the embodiment described above, the embodiment of the present invention is applied to an inkjet printer in one axis printing medium moving type and one axis printer head moving type as an example of a printer apparatus. However, the embodiment of the present invention may be applied to another type of an inkjet printer, for example, an inkjet printer in two axes printer head moving type or the like.

According to the printer apparatus in accordance with the embodiment of the present invention which is structured as described above, when acceleration detected by the acceleration detecting means exceeds the predetermined threshold value, it is judged that the printer head has contacted with a printing medium and occurrence of jamming is immediately foreseen or detected and thus detection accuracy of occurrence of jamming is improved with a small and compact structure. Therefore, when acceleration acted on the carriage during the relative movement exceeds the predetermined threshold value, control of restricting relative movement of the carriage is executed and thus the carriage is prevented from being relatively moved under the state that the printer head has contacted with the printing medium and, as a result, the printer head is surely prevented from being damaged by friction against the printing medium or the like.

Further, in the above-mentioned printer apparatus, it is preferable that the condition of abnormality occurred in the carriage is judged on the basis of a direction of acceleration which exceeds the threshold value and the relative movement of the carriage is restricted on the basis of restriction content which is determined according to the condition of abnormality. According to this structure, it is judged that peculiar abnormality corresponding to a direction of the acceleration has occurred and restriction control corresponding to the content of abnormality is executed on the relative movement of the carriage. More specifically, when judgment of minor contact is obtained, restriction control is executed in which the carriage is stopped after one scanning of the carriage has been finished and, when judgment of occurrence of jamming is obtained, restriction control is executed in which the carriage is urgently stopped. Therefore, an appropriate restriction control corresponding to the condition of abnormality is executed on the relative movement of the carriage.

In addition, in the above-mentioned printer apparatus, it is preferable that a notifying means is further provided which notifies content of the condition of abnormality on the basis of judgment result by the control means. According to this structure, the content of abnormality and the method for restoration are rapidly notified to an operator. Therefore, an operator is capable of definitely recognizing a cause of abnormality in the relative movement of the carriage and thus an appropriate measure for restoring from the abnormality can be performed.

Further, in the above-mentioned printer apparatus, it is preferable that the acceleration on the basis of the relative movement of the carriage which is distinguished by the acceleration distinguishing means is excluded from an object to be compared with the predetermined threshold value by the control means. According to this structure, occurrence of abnormality such as jamming is further surely detected by means of that, among accelerations acted on the carriage, a peculiar acceleration except the acceleration and deceleration of the carriage is detected.

Obviously, numerous modifications and variations of the present invention are possible in light of the above teachings. It is therefore to be understood that within the scope of the appended claims, the invention may be practiced otherwise than as specifically described herein.

The invention claimed is:

1. A printer apparatus comprising:

a medium supporter to support a printing medium;

a carriage to hold a printer head provided with a nozzle from which ink is to be ejected onto a printing surface of the printing medium;

a carriage moving mechanism to move the carriage along the printing surface of the printing medium supported by the medium supporter;

an acceleration detector configured to detect acceleration of vibration generated in the carriage;

a determining device configured to determine whether a magnitude of the acceleration detected by the acceleration detector exceeds a first predetermined threshold value or a second predetermined threshold value; and a controller configured to control the carriage moving mechanism to restrict relative movement of the carriage when the determining device determines that the magnitude of the acceleration detected by the acceleration detector exceeds the first predetermined threshold value or the second threshold value, wherein the controller is configured to immediately stop movement of the carriage when the magnitude of the acceleration exceeds the first predetermined threshold value and to stop movement of the carriage after completion of a scanning pass of the carriage when the magnitude of the acceleration exceeds the second predetermined threshold value.

2. The printer apparatus according to claim 1, wherein the acceleration detector is configured to detect accelerations of vibrations in at least two or more directions generated in the carriage, wherein the first predetermined threshold value is set for respective directions of the at least two or more directions, wherein the determining device is configured to determine whether each of magnitude of the accelerations in the at least two or more directions detected by the acceleration detector exceeds the first predetermined threshold value in a corresponding direction, and wherein when the determining device determines that at least one of the magnitude of the accelerations in the at least two or more directions detected by the acceleration detector exceeds the first predetermined threshold value in a corresponding direction, the controller is configured to judge condition of abnormality which is occurred in the carriage based on a direction of acceleration where at least one of the magnitude of the accelerations exceeds the first predetermined threshold value and is configured to control the carriage moving mechanism to restrict the relative movement of the carriage based on restriction content determined according to the condition of abnormality.

3. The printer apparatus according to claim 2, further comprising:

a notifying device to indicate content of the condition of abnormality based on judgment result by the controller.

4. The printer apparatus according to claim 3, further comprising:

an acceleration distinguishing device configured to distinguish (i) acceleration generated in the carriage based on the relative movement of the carriage by the carriage moving mechanism from (ii) acceleration generated in the carriage based on vibration due to contacting of the carriage with the printing medium, wherein the acceleration of the relative movement of the carriage distinguished by the acceleration distinguishing device is excluded from an object to be compared with the first predetermined threshold value and the second predetermined threshold value by the determining device.

5. The printer apparatus according to claim 2, further comprising:

an acceleration distinguishing device configured to distinguish (i) acceleration generated in the carriage based on the relative movement of the carriage by the carriage moving mechanism from (ii) acceleration generated in the carriage based on vibration due to contacting of the carriage with the printing medium, wherein the acceleration of the relative movement of the carriage distinguished by the acceleration distinguishing device is excluded from an object to be compared the first predetermined threshold value and the second predetermined threshold value by the determining device.

6. The printer apparatus according to claim 1, further comprising:

an acceleration distinguishing device configured to distinguish (i) acceleration generated in the carriage based on the relative movement of the carriage by the carriage moving mechanism from (ii) acceleration generated in the carriage based on vibration due to contacting of the carriage with the printing medium, wherein the acceleration of the relative movement of the carriage distinguished by the acceleration distinguishing device is excluded from an object to be compared with the first predetermined threshold value and the second predetermined threshold value by the determining device.

* * * * *